US005836711A

United States Patent [19]

Stewart

[11] Patent Number: 5,836,711

[45] Date of Patent: Nov. 17, 1998

[54] RING NOTEBOOK ADAPTER

[76] Inventor: Richard M. Stewart, 731 Ojai Ave., Sun City Center, Fla. 33573

[21] Appl. No.: 901,759

[22] Filed: Jul. 28, 1997

[51] Int. Cl.[6] ..... B42F 13/00

[52] U.S. Cl. ..... 402/79; 402/4; 402/80 R; 402/57; 402/500; 281/38; 281/43; 281/45; 281/15.1; 281/21.1; 281/19.2

[58] Field of Search ..... 281/38, 43, 44, 281/45–49, 15.1, 21.1, 28, 51, 36, 19.2; 402/4, 79, 80 R, 57, 75, 58, 500

[56] References Cited

U.S. PATENT DOCUMENTS

| | | | |
|---|---|---|---|
| Re. 34,593 | 4/1994 | Moncrieff Baldwin et al. | 402/80 R |
| 379,874 | 3/1888 | Meston et al. . | |
| 520,856 | 6/1894 | Milliron . | |
| 1,005,376 | 10/1911 | Verges . | |
| 1,014,926 | 1/1912 | Westervelt . | |
| 1,044,765 | 11/1912 | Feldman . | |
| 1,220,294 | 3/1917 | Turner . | |
| 2,052,484 | 8/1936 | Murray . | |
| 2,178,887 | 11/1939 | Fabry . | |
| 2,291,512 | 7/1942 | Trussell . | |
| 2,602,452 | 7/1952 | Donato et al. . | |
| 2,709,440 | 5/1955 | Donato et al. . | |
| 3,293,716 | 12/1966 | Sanders et al. . | |
| 3,617,074 | 11/1971 | Rigolini et al. . | |
| 3,839,759 | 10/1974 | Staats et al. . | |
| 4,420,271 | 12/1983 | Zabielski | 402/80 L |
| 4,436,442 | 3/1984 | Miskin | 402/73 |
| 4,595,309 | 6/1986 | Chinchar | 402/80 R |
| 4,624,480 | 11/1986 | Marthaler et al. | 281/49 |
| 4,902,183 | 2/1990 | Vercillo et al. | 281/21.1 |
| 4,930,925 | 6/1990 | Baldwin et al. | 402/80 R |
| 5,056,823 | 10/1991 | Stancato | 281/49 |
| 5,186,497 | 2/1993 | Van Pinkerton, Jr. | 281/49 |
| 5,553,891 | 9/1996 | Ong | 281/43 |
| 5,597,256 | 1/1997 | Burton et al. | 402/4 |
| 5,722,692 | 3/1998 | Abramov | 281/43 |

*Primary Examiner*—Frances Han
*Attorney, Agent, or Firm*—William C. Crutcher

[57] ABSTRACT

An adapter for holding a spiral bound booklet in a multiple ring notebook. The adapter comprises a flat carrier with holes to receive the notebook rings and supports an elongated rod which passes through the spirals of the spiral binding. End crowns are removable to allow removal of the elongated rod from the spirals.

8 Claims, 2 Drawing Sheets

RING NOTEBOOK ADAPTER

BACKGROUND OF THE INVENTION

Figures 1, 1A:
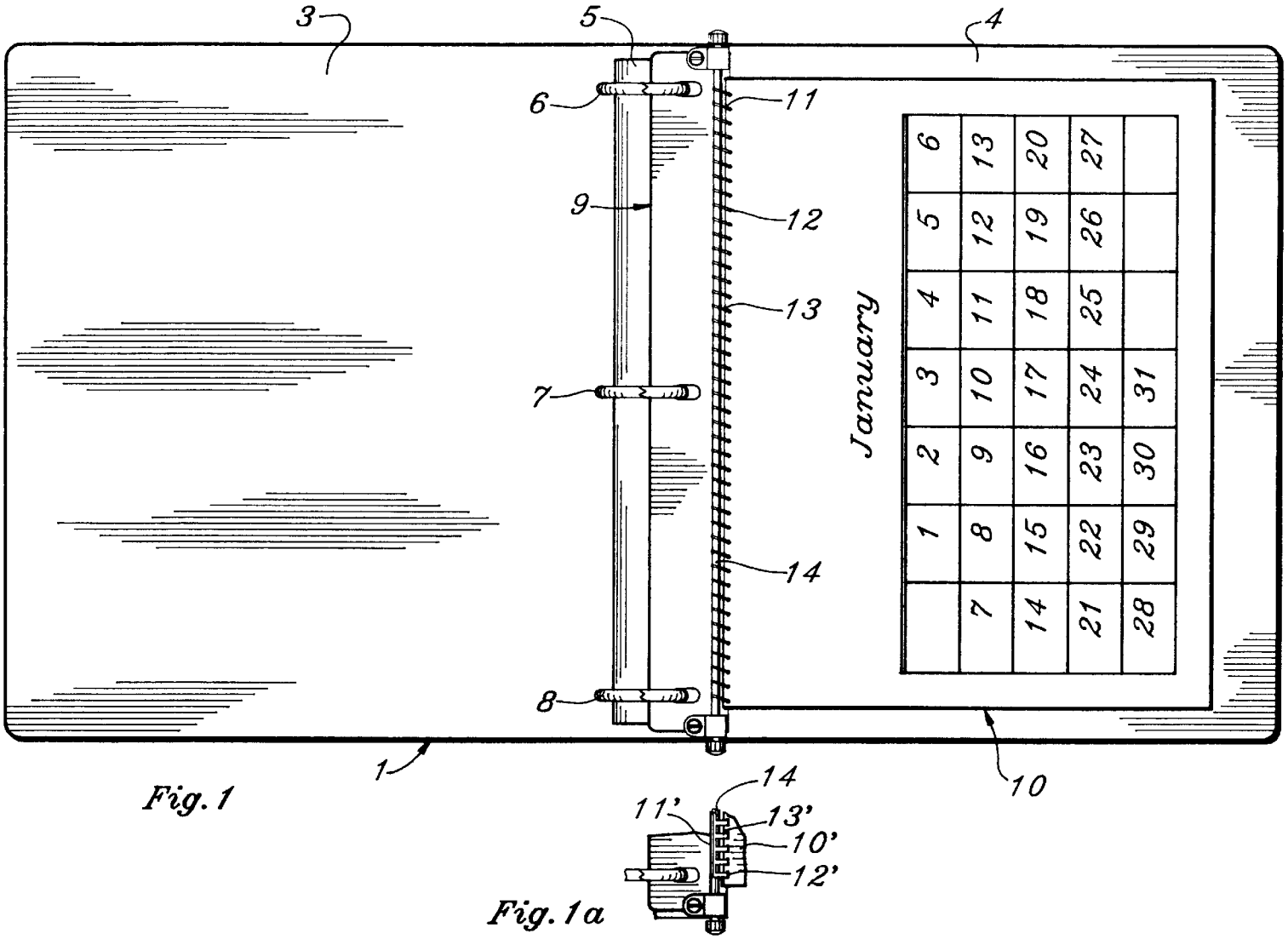

This invention relates generally to notebooks and binders for pages of printed matter and the like. More particularly, this invention relates to an adapter for holding a conventional spiral bound booklet, in a conventional ring notebook.

Ring notebooks for holding individual pages of printed or graphic material are well known in the art. Although there are many variations of ring notebooks, the most common is a three-ring loose leaf notebook, with a spine for holding the rings and a mechanism for opening and closing the rings, holding the rings in an open position while pages are inserted or removed, and holding the rings in closed position to allow the pages to be turned and prevent them from falling out. Ring notebook is defined herein as including any such similar notebook with two or more rings which may be opened and closed, which are usually circular, but need not necessarily be so, and regardless of the mechanism which opens and closes the rings.

Another type of binding, which is intended to be more or less permanent, is a well-known conventional binding in which a number of coaxial ring-shaped elements pass through corresponding holes along the edge of a sheaf of pages, the coaxial elements being part of a common member. A well-known binding of this type is the spiral binding, in which a single helix of wire is passed successively through spaced holes along one side of a sheaf of pages, each element in the helix being coaxial with all of the other elements. A variation of the spiral binding is one in which a tubular plastic member incorporates coaxial curled comb-like tine elements attached to a common elongated rib part, the coaxial elements again passing through respective slots spaced along an edge of a sheaf of papers. Such a binding is normally made of plastic and sometimes called a "plastic comb" binding, and is shown in U.S. Pat. No. 3,180,488 issued Apr. 27, 1965 to Heusmann, which is incorporated herein by reference. As used herein, the term "spiral binding" is intended to encompass either a wire helical binding or a plastic comb binding, both of which incorporate coaxial elements on a binding member.

While either a ring notebook binder or a spiral bound booklet enable one to turn over a number of pages so that the pages lie flat for viewing, they remain two distinct types of bindings used for different purposes. A ring notebook is intended to facilitate easily replacing single sheets, whereas a spiral binding is normally intended to provide a more or less permanent binding.

It would be desirable to combine the features of a permanently bound spiral bound document with the convenience of a ring notebook by attaching the spiral bound document to the notebook rings. There are a number of reasons why this is not feasible. First, it would be necessary to punch additional holes, depending on the number of rings in the ring notebook into the pages of the spiral bound document. This would normally require disassembly of the spiral bound document in order to punch holes in the separate pages and then to reassemble it.

Secondly, spiral bound documents are not necessarily the same size as the standard pages carried in a ring binder. Sometimes they are much smaller.

Various types of adapters and holders for objects in a notebook binding are shown in the following U.S. Patents:

U.S. Pat. No. 1,948,689 issued Feb. 27, 1934 to Taylor;

U.S. Pat. No. 2,732,841 issued Jan. 31, 1956 to Schade;

U.S. Pat. No. 4,990,018 issued Feb. 5, 1991 to Best et al.;

U.S. Pat. No. 5,018,897 issued May 28, 1991 to Horgan.

None of the above patents address the problem of holding a spiral bound booklet in a multiple ring notebook.

Accordingly, one object of the present invention is to provide an improved adapter for combining a ring notebook with a spiral bound booklet.

Another object of the invention is to provide an adapter for holding a spiral bound book in a ring notebook.

Still another object of the invention is to provide a means for detachably carrying a spiral bound booklet notebook in a ring notebook binder.

SUMMARY OF THE INVENTION

Briefly stated, the invention comprises an improved adapter for holding a plurality of pages bound by coaxial elements of a binding member, i.e., a spiral bound volume, within a ring notebook of the type having a spine and a plurality of spaced rings attached to the spine which may be opened and closed. The adapter comprises an elongated substantially flat carrier member, having a length approximately the same as that of the spine and defining a plurality of holes along the carrier member spaced to correspond to the spacing of the rings of the notebook and arranged to receive the rings when they are opened and to hold the carrier member when the rings are closed. An elongated rod member is adapted to extend axially through the coaxial elements so as to hold the plurality of pages from the coaxial elements. The rod member has opposite end portions extending beyond the coaxial elements, with first means supporting the end portions of the elongated rod member on respective opposite ends of the carrier member, and having second means for temporarily detaching at least one end portion of the elongated rod member from the first means, so as to enable the elongated rod member to pass axially through the coaxial elements.

DRAWING

Figure 3:
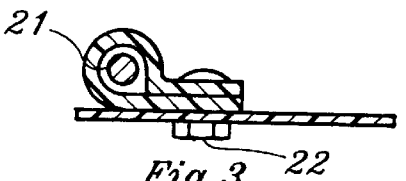
Figure 2:
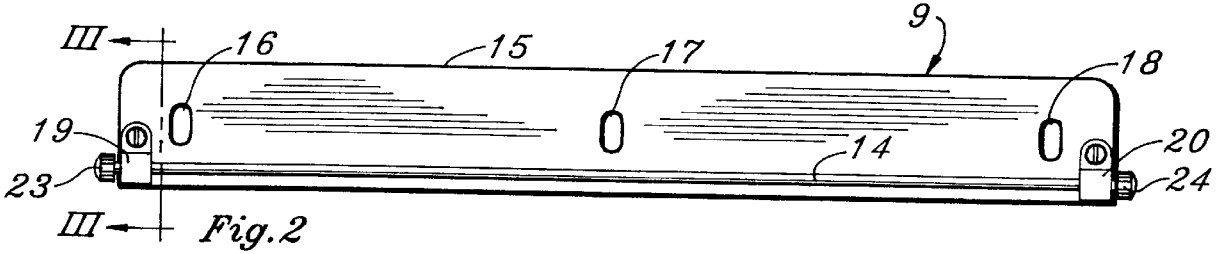
Figure 5:
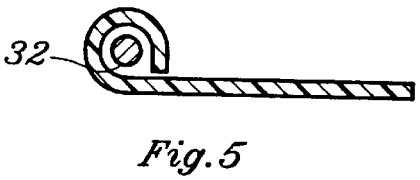
Figure 4:
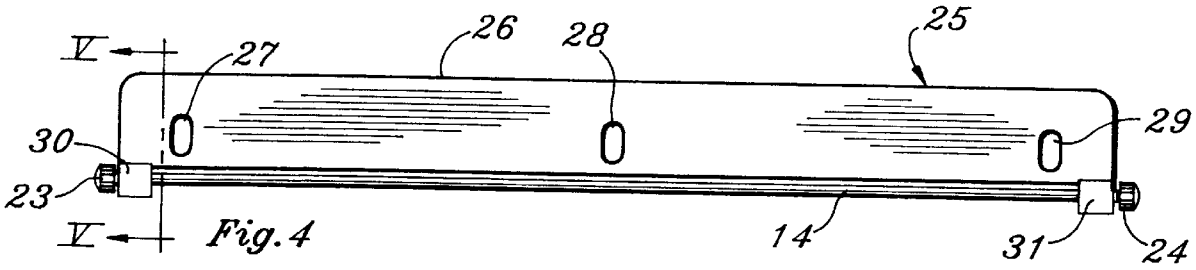
Figure 7:
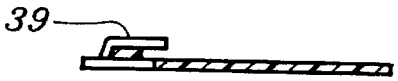
Figure 6:
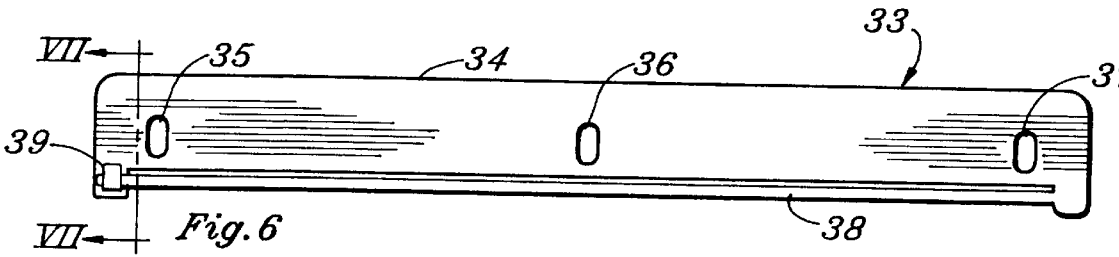
Figure 8:
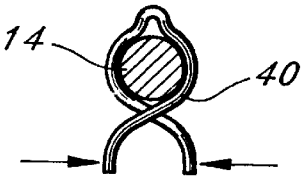

The subject matter which is regarded as the invention is particularly pointed out and distinctly claimed in the concluding portion of this specification. The invention, however, both as to organization and method of practice, together with further objects and advantages thereof, may best be understood by reference to the following description, taken in connection with the accompanying drawing, in which:

FIG. 1 is a top plan view of a ring binder in the open position, holding a spiral bound notebook using my improved adapter, FIG. 1*a* is a partial view of a plastic comb binding, FIG. 2 is a top plan view of the adapter shown in FIG. 1, FIG. 3 is a side elevational view in cross-section taken along lines III—III of FIG. 2, FIG. 4 is a top plan view of a modified adapter, FIG. 5 is a side elevational view in cross-section, taken along lines V—V of FIG. 4, FIG. 6 is a top plan view of another modification of the adapter, FIG. 7 is a side elevational view in cross-section, taken along lines VII—VII of FIG. 6, and FIG. 8 is an end view of a rod member with a friction clip.

Referring to FIG. 1 of the drawing, a conventional three ring notebook, shown generally at 1, is illustrated in open position with a front cover 3, a back cover 4 adapted to close about a metal spine 5. Spine 5 carries rings 6, 7, 8 with a conventional mechanism (not shown) for holding the rings either in open position or for holding the rings in a closed position (as shown). Rings 6, 7 and 8 are normally circular, but may also be D-shaped or elongated as is well known in the art.

In accordance with the present invention, an adapter 9 is held by the rings 6, 7, 8 which, in turn, holds a spiral bound booklet shown generally at 10. The spiral bound booklet comprises a sheaf of pages, which may be blank pages or pages of drawings, a printed publication, a calendar or any other type of document which is intended to be bound more or less permanently. As illustrated herein, the spiral bound volume comprises a calendar with the month of January exhibited. The pages of document 10 are held together by a binding member 11 which, in the case illustrated is a single spiral of wire in the shape of a helix. The pages of document 10 are punched with spaced holes 12 along one edge of the pages. One turn or element of the helical coil passes through each hole, such as the element 13. All such elements of the binding member 11 are coaxial with one another. An elongated rod member 14 which is part of the adapter 9 passes through the coaxial elements and holds the spiral bound booklet 10 in place.

While FIG. 1 illustrates a metal spiral binding, an equivalent construction is known as a plastic comb binding, which performs in substantially the same way.

FIG. 1*a* illustrates a partial view of an equivalent binding, wherein the document 10' is held by a binding member 11'. A series of slots 12' are punched along the edge of document 10'. A series of curled plastic tines provide coaxial elements 13' attached to the common rib member 11' which pass through the slots 12' to hold the pages in place. The elongated rod 14 then passes through the coaxial elements 13'.

Referring to FIG. 2 of the drawing, the adapter of FIG. 1 is shown in greater detail. Adapter 9 comprises an elongated substantially flat carrier member 15, preferably punched from flat plastic stock to a length approximately equal to that of the spine 5 of the ring notebook. Holes 16, 17, and 18 are punched to correspond to the size and spacing of the rings 6, 7 and 8, preferably elongated somewhat to allow movement in the binder. Means for holding the elongated rod member 14, which may be a circular steel rod, comprise a pair of receptacles 19, 20 at opposite ends of carrier member 15 receptacles 19, 20 have openings 21, (FIG. 3) receiving the end portions of rod 14 which extend beyond the coaxial elements in the spiral binding. Receptacles 19, 20 may comprise loops of plastic stock formed as illustrated in FIG. 3 and held by screws 22. The elongated rod 14 is threaded on opposite ends and provided with knurled, internally threaded crowns 23, 24. By removing either of the crowns 23 or 24, means are provided for temporarily detaching at least one end portion of the elongated rod member 14 by allowing rod 14 to be withdrawn from the coaxial elements of the spiral binding. An alternate means for temporarily detaching the same rod member would utilize crowns with friction clips on the ends of the rod, as shown as shown in FIG. 8. A friction clip 40 of spring metal pressed over the end of rod member 14 may be removed by squeezing the ends of the friction clip. Many alternate types of friction clips are known in the art. By removing the rod, another page of the spiral bound booklet 10 may be turned and exposed to view, such as the next month in a calendar.

A modified form of the invention is shown in FIG. 4. An adapter, shown generally as 25, comprises an elongated substantially flat carrier member 26 punched with holes 27, 28 and 29 as before to correspond to the binder rings. An elongated rod member 14, with threaded ends and removable crowns 23, 24 is constructed as previously described. In this case, the receptacles for the opposite end portions of the elongated rod member, shown by reference numbers 30, 31 are integral with and formed from the same stock as the carrier member. As illustrated in the end view of FIG. 5, the flaps of the carrier member are curled around and caused to form holes 32 for receiving the ends of the rod members.

Referring to FIG. 6, another modification of the invention is illustrated. An adapter, shown generally as 33 is formed by an elongated substantially flat carrier member 34. Carrier member 34 has holes 35, 36, 37 punched as before. In this case, the elongated rod member comprises an integral portion 38, affixed at one end to the carrier member 34, and the other end is adapted for attachment or detachment to a tab 39 protruding from the carrier member. In the FIG. 6 modification, the end of the elongated rod member 38 is slipped from the tab 39 in order to remove it from the coaxial elements of the spiral binding, and then reinserted after rod member 38 has been reinserted into the coaxial elements.

The adapter is especially useful for holding calendars, or special shaped spiral notebooks in a ring binder. The pages of the spiral binder may be viewed separately in the manner of the pages in the ring notebook itself. Alternatively the binder may be removed from the notebook, the pages turned to expose a desired page and then reattached to the notebook, so that a reference page is always in view when desired.

Also, a ring binder notebook with decorative cover may be employed simply as a cover for a calendar or similar spiral bound publication which may not itself have a desirable cover on it for leaving exposed to view. Furthermore, by using several adapters, a number of spiral bound notebooks can be held in a single large three-ring binder, or a number of uniformly colored or decorated three-ring binders may be used to hold a number of spiral notebooks of different sizes and shapes in an aesthetically uniform fashion.

While there has been described what is considered to be the preferred embodiment of the invention, other modifications will occur to those skilled in the art and it is desired to secure in the appended claims all such modifications as found within the true spirit and scope of the invention.

I claim:

1. An adapter for holding a plurality of pages bound by coaxial elements of a binding member, within a notebook of the type having a spine and a plurality of spaced rings attached to the spine which may be opened and closed, the adapter comprising:

an elongated substantially flat carrier member having a length approximately the same as that of the spine and defining a plurality of holes along the carrier member spaced to correspond to the spacing of the rings of said notebook and arranged to receive the rings when they are opened and to hold the carrier member when the rings are closed, an elongated rod member adapted to extend axially through coaxial elements of a binding member so as to hold a plurality of pages bound by coaxial elements and having opposite end portions extending beyond the coaxial elements, first means supporting the end portions of the elongated rod member on respective opposite ends of the carrier member, and second means for temporarily detaching at least one end portion of the elongated rod member from said first means to enable the elongated rod member to pass axially through the coaxial elements.

2. An adapter according to claim 1, wherein said first means comprises a pair of receptacles attached to the carrier member and adapted to receive the end portions of the elongated rod member.

3. An adapter according to claim 1, wherein said first means comprise receptacles formed in opposite ends of the carrier member and adapted to receive end portions of the elongated rod member.

4. An adapter according to claim 1, wherein said second means comprises threads on at least one end portion of the rod member and includes at least one threaded crown member arranged to fit the at least one end portion of the elongated rod member for temporary removal.

5. An adapter according to claim 1, wherein said second means comprises a friction clip on at least one end portion of the rod member which may be removed by squeezing said friction clip.

6. An adapter according to claim 1, wherein the elongated rod member comprises an integral portion of the elongated carrier member and is affixed thereto at one end.

7. An adapter according to claim 6, wherein said second means comprises a tab for receiving the other end of the elongated rod member which is not affixed to the carrier member.

8. An improved adapter for holding a plurality of pages bound by coaxial elements of a spiral binding member in a ring notebook having a spine and at least two spaced rings attached to the spine which may be opened and closed, the adapter comprising, an elongated substantially flat plastic carrier member having a length approximately the same as that of the spine and defining at least two holes along the carrier member spaced to correspond to the spacing of the rings of the notebook and arranged to receive the rings when they are opened and to hold the carrier member when the rings are closed, an elongated metal rod member adapted to extend axially through the coaxial elements of the spiral notebook binding so as to hold the plurality of pages from the coaxial elements and having opposite end portions extending beyond the coaxial elements, a pair of receptacles disposed on opposite ends of the elongated carrier member and arranged to receive the end portions of the elongated rod member, and means for temporarily detaching at least one end portion of the elongated rod member to enable the elongated rod member to pass axially through the coaxial elements.

* * * * *